United States Patent [19]

Stark

[11] 4,272,138

[45] Jun. 9, 1981

[54] CABINET DRAWER ANTI-TIP LOCK DEVICE

[75] Inventor: Forest G. Stark, Jamestown, N.Y.

[73] Assignee: AVM Corporation, Jamestown, N.Y.

[21] Appl. No.: 26,220

[22] Filed: Apr. 2, 1979

[51] Int. Cl.[3] ..... E05C 7/06; A47B 88/00

[52] U.S. Cl. ..... 312/221; 312/107.5; 312/216; 312/333

[58] Field of Search ..... 312/221, 216, 215, 217, 312/219, 319, 107.5, 333

[56] References Cited

U.S. PATENT DOCUMENTS

| | | | |
|---|---|---|---|
| 1,063,844 | 6/1913 | Swanson | 312/221 |
| 2,240,067 | 4/1941 | Bolesky et al. | 312/221 |
| 2,719,770 | 10/1955 | Roberts | 312/221 |
| 2,842,419 | 7/1958 | Howard | 312/218 |
| 2,992,056 | 7/1961 | Thelker | 312/221 |
| 3,033,634 | 5/1962 | Ribbens et al. | 312/219 |
| 3,199,937 | 8/1965 | Mitchell | 312/221 |
| 3,297,376 | 1/1967 | Barstow | 312/219 |
| 3,323,849 | 6/1967 | Stark | 312/221 |
| 3,325,234 | 6/1967 | Lewin | 312/219 |
| 3,331,644 | 7/1967 | Kafferlin | 312/221 X |
| 3,361,509 | 1/1968 | Leuenberg | 312/273 |
| 3,404,929 | 10/1968 | Wright et al. | 312/216 |
| 3,408,002 | 10/1968 | Martin . | |
| 3,602,564 | 8/1971 | Lewin | 312/220 |
| 3,622,216 | 11/1971 | Hauklost | 312/219 |
| 3,881,793 | 5/1975 | Anderson | 312/217 |
| 3,883,200 | 5/1975 | Latham | 312/216 |
| 3,888,558 | 6/1975 | Himsl | 312/216 |
| 3,900,236 | 8/1975 | Goulish et al. | 312/217 |
| 3,909,090 | 9/1975 | Breckner | 312/217 |
| 3,969,008 | 7/1976 | Pergler | 312/221 |

*Primary Examiner*—James T. McCall

*Attorney, Agent, or Firm*—Bean, Kauffman & Bean

[57] ABSTRACT

A file cabinet having drawers and doors and an anti-tip lock mechanism that simultaneously locks all closed doors and drawers when in a locking mode and that permits movement of a single drawer from its closed to its open position while simultaneously locking both the remaining unopened doors and all of the other drawers against movement from their closed to their open positions when in an unlocked mode.

16 Claims, 6 Drawing Figures

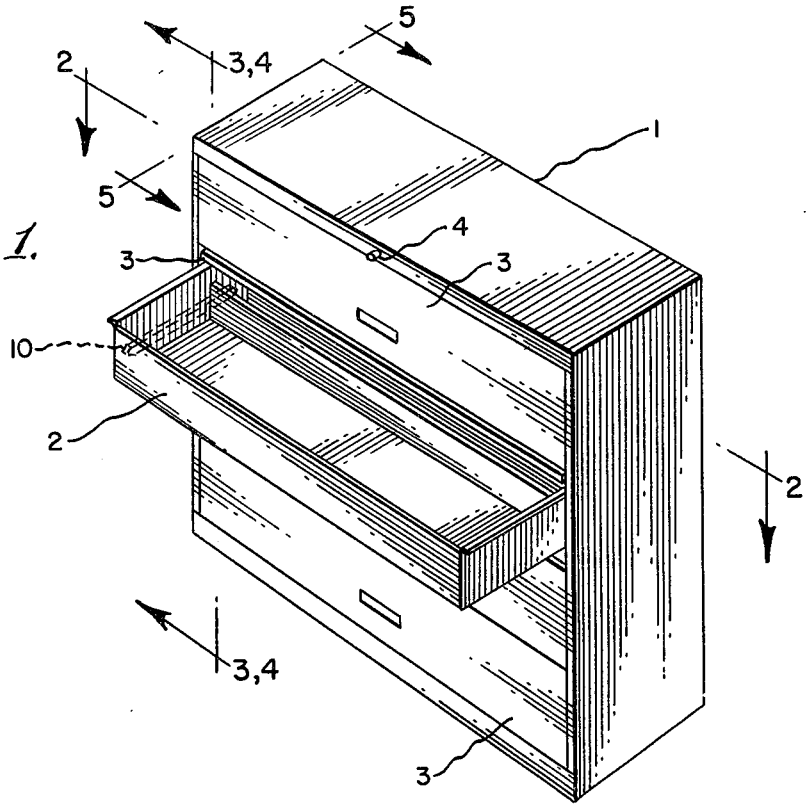
Fig. 1.
Fig. 2.
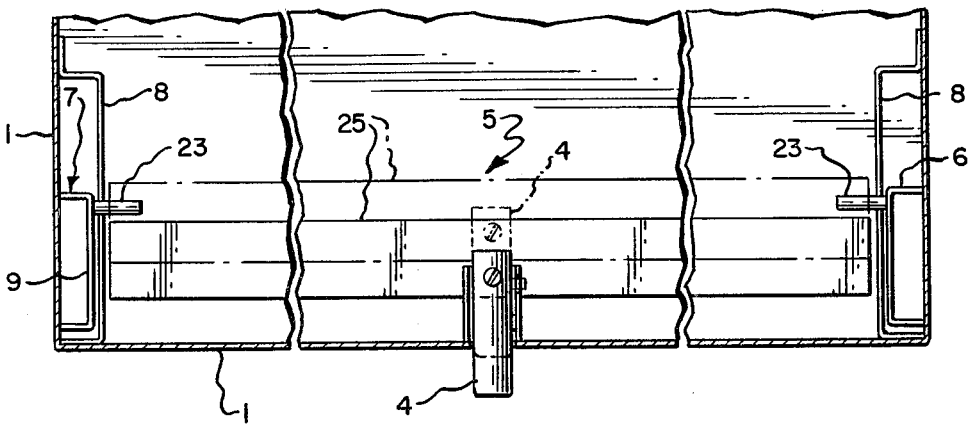

Fig. 6.
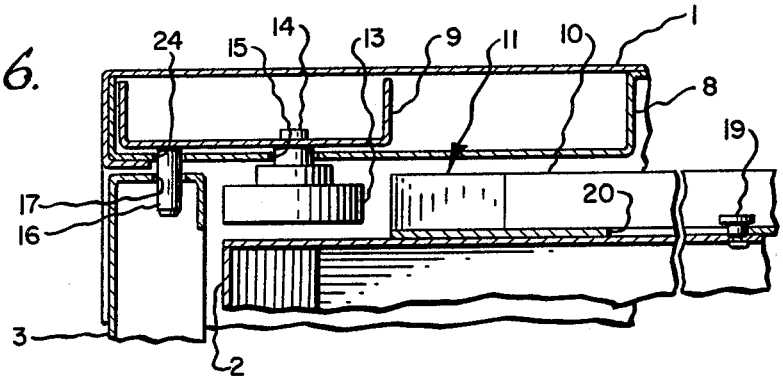
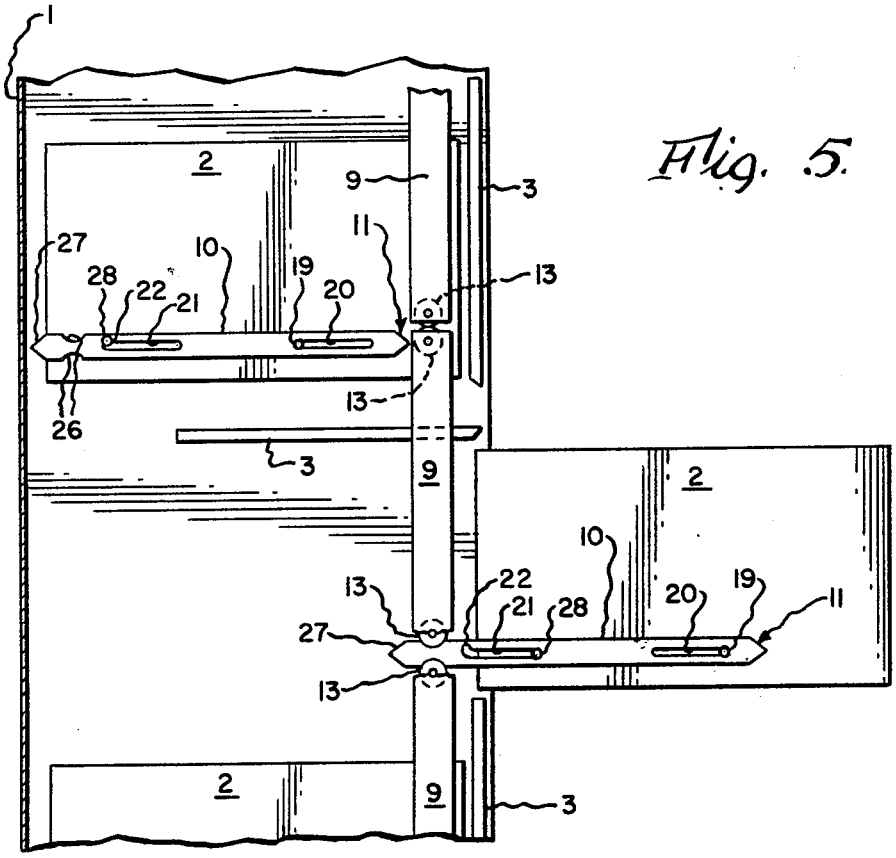
Fig. 5.

CABINET DRAWER ANTI-TIP LOCK DEVICE

TECHNICAL FIELD OF THE INVENTION

The present invention relates to file cabinets and locking means for preventing cabinet drawer openings. More specifically, the invention relates to a locking means and anti-tip mechanism for lateral files having vertically arranged roll-out drawers or shelves and horizontally pivoted doors therefor.

BACKGROUND OF THE INVENTION

It has long been a primary objective of those working in the filing cabinet and business office furniture art to provide means whereby a filing cabinet may not only be locked against unauthorized entry but also to provide an anti-tip mechanism which secures the doors and/or drawers of the cabinet against the sequential opening of more than one drawer at any one particular time. It has also been a further and long time objective of those versed in the art to find a means whereby the foregoing objective could be economical fashion. That these objectives have not been satisfactorily achieved is evidenced by the multitude of inventions proposed to this end, representative of which are those disclosed in the following U.S. Pat. Nos. 3,900,236 issued Aug. 19, 1975; 3,199,937 issued Aug. 10, 1965; 3,888,558 issued June 10, 1975; 3,404,929 issued Oct. 8, 1968; 3,883,200 issued May 13, 1975; 3,602,564 issued Aug. 31, 1971; and 3,297,376 issued Jan. 10, 1967.

Filing cabinets heretofore proposed, such as those patents listed above, have suffered from a variety of deficiencies and difficulties. While the prior art anti-tip mechanisms have been generally successful in preventing more than one drawer from being opened at a time when the drawers are opened only one at a time, most such anti-tip mechanisms have been ineffective in preventing more than one drawer from being opened simultaneously. Thus, U.S. Pat. Nos. 3,888,558; 3,883,200 and 3,404,929 are examples of cabinets which do not prevent the simultaneous opening of more than one drawer and U.S. Pat. No. 3,602,564 is exemplary of a cabinet which includes a door interlock which does not prevent more than one door from being opened simultaneously. This deficiency in the prior art designs may lead to the upsetting of the entire cabinet when the cabinet itself is tipped slightly so that the drawers tend to run open of their own weight at the same time: a not uncommon circumstance when the cabinet is being moved. The solution to this problem proposed by U.S. Pat. Nos. 3,900,236 and 3,199,937 involve significant complications of the design of the anti-tip mechanism, which complications lead to excessive costs and difficulties in assembly of the cabinets.

An additional problem which has been encountered when prior anti-tip devices have been incorporated in filing cabinets is that such mechanisms frequently add additional depth to the cabinet and/or do not permit the drawer of the cabinet to be opened to a degree that the contents of the drawer can be removed vertically from the opened drawer. This difficulty is magnified when the cabinet is of the lateral file type in which cabinet depth is of primary importance and in which vertical deposit and removal of the filing material is a requirement. In an attempt to address this requirement, U.S. Pat. No. 3,900,236 has proposed a device having a complicated camming keeper mechanism which is subject to failure in the event that debris or rust were to interfere with the motion of the cam wheel and is both expensive and difficult to fabricate. Furthermore, since the keeper mechanism is actuated upon opening and removal of one drawer from the cabinet, and is not deactivated until the drawer is returned to its closed position, all of the remaining drawers are prevented from complete removal from the cabinet in the event that it is desirable to lighten the cabinet to facilitate its transport by the complete removal of all of the drawers. Accordingly, the file cabinet disclosed by U.S. Pat. No. 3,900,236 can be lightened by the complete removal of only one drawer at any one time, which capability may not be of any significant help when the cabinet is transported. Further lightening of the cabinet requires the inconvenient expedient of removing the contents of the other drawers rather than complete removal of the drawers themselves.

THE INVENTION

These and other difficulties encountered by the prior art filing cabinet anti-tip mechanisms have been overcome by the invention to be described in summary fashion below and in complete detail in the following description of the best mode of the invention. The improved file cabinet of the present invention has particular application to lateral filing cabinets of the type having a cabinet housing with a plurality of horizontally moveable components such as roll-out shelves, drawers or other storage units therein with an equal plurality of doors moveable from a closed, blocking position to an open, releasing position.

The improved anti-tip mechanism described and claimed herein includes a segmented column consisting of a plurality of longitudinally extending snubber elements axially aligned in end-to-end abutting relation. The columns extend adjacent to each component and the column, and/or the individual snubber elements, are resiliently mounted within the cabinet to permit movement between a central equilibrium position and one of two opposite axially displaced positions. Each drawer carriers on its side an activator rail which is disposed at right angles to the column. The tapered end of each activator rail is positioned so as to insinuate itself between two adjacent abutting snubber elements when the respective component is opened. The act of activator rail insinuation between adjacent snubber elements causes each of the snubber elements in the column to be displaced from a central equilibrium position to one of two displaced positions. In their displaced positions, the snubber elements block subsequent opening of any second component.

Further, the improved file cabinet of the present invention includes a lock means for simultaneously locking the doors and the components against movement from their closed to their open positions when in a locking mode and for permitting movement of a single drawer from its closed to its open position while simultaneously locking both the remaining unopened doors and all of the other drawers against movement from their closed to their open positions when in an unlocking mode.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIG. 1 is a perspective view of a typical lateral file having horizontally pivoted doors and horizontally moveable drawers;

FIG. 2 is a cross-section view of the locking linkage of the cabinet of FIG. 1 taken along view lines 2—2;

FIG. 5 is a simplified side elevation showing one drawer extended so as to illustrate the functioning of the anti-tip mechanism of the invention; and FIG. 6 is a cross-section of the mechanism illustrated in FIG. 3 taken along the view lines 6—6.

DESCRIPTION OF THE BEST MODE OF THE INVENTION

Figure 3:
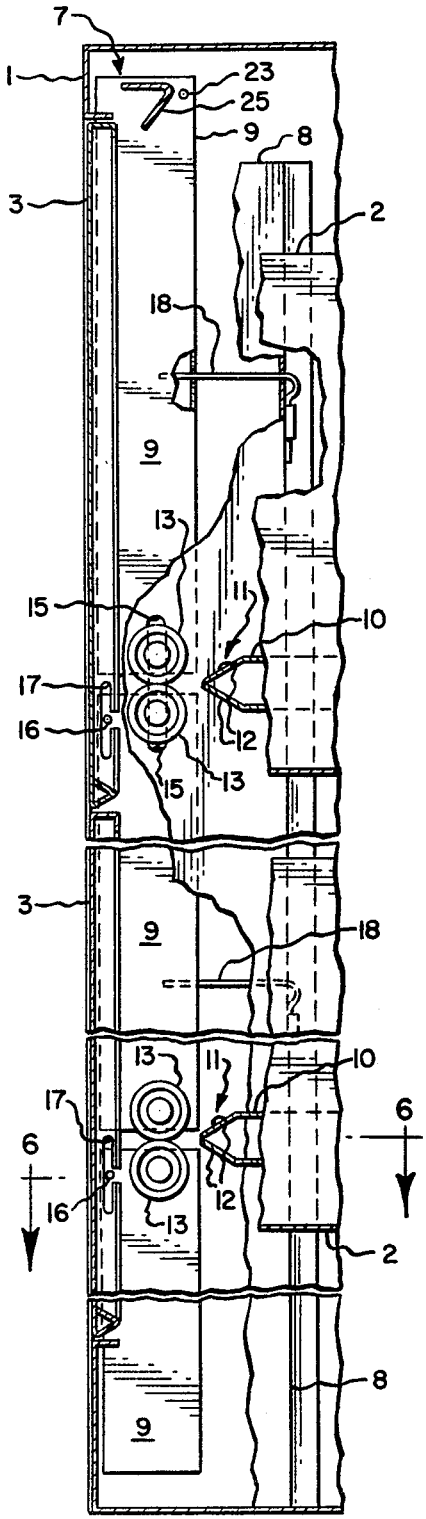
FIG. 3 is a partial cross-section side elevation of the anti-tip mechanism of the invention in unlocked unsnubbed attitude taken along view lines 3—3 of FIG. 1.

While the invention is susceptible of various modifications and alternative constructions, there is shown in the drawings and there will hereinafter be described, in detail, a description of the preferred or best known mode of the invention. It is to be understood, however, that the specific description and drawings are not intended to limit the invention to the specific form disclosed. On the contrary, it is intented that the scope of this patent include all modifications and alternative constructions thereof falling within the spirit and scope of the invention as expressed in the appended claims to the full range of their equivalents.

FIG. 1 generally illustrates a cabinet which consists of a cabinet housing 1, a plurality of vertically arranged horizontally moveable components 2 and an equal plurality of doors 3 which may be closed over the components when in their retracted positions. In the context of a lateral file, the moveable components may be roll-out shelves or drawers or other similar storage units: the term drawer being used hereafter for the sake of simplicity. A reciprocating key operated plunger lock 4 is provided to lock and unlock both the doors and drawers.

Figure 4:
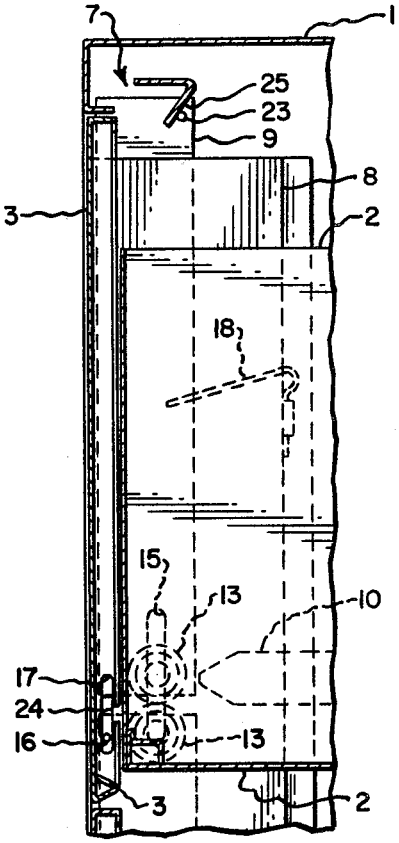
FIG. 4 is an illustration similar to that shown in FIG. 3 but showing the cabinet in a drawer and door locking mode.

Operation of the locking mechanism of the cabinet may be better seen in FIG. 2 which shows one possible linkage 5 between the plunger lock 4 with a pair of locking bars 6 and 7 vertically disposed at opposite lateral sides of the cabinet housing 1. The illustrated locking linkage 5 comprises a laterally extending member 25, such as a piece of angle iron, centrally, pivotally mounted on the end of plunger lock 4. Opposite ends of cam angle 25 engage studs 23 carried by locking bars 6 and 7 so that depression of plunger lock causes locking bars 6 and 7 to be driven downwardly to a "locking" position (FIGS. 3 and 4).

In a preferred embodiment, locking bars 6 and 7 are mounted within a vertically extending channel 8, which is part of the cabinet, in a manner which permits the vertically extending lock bars 6 or 7 to be vertically or axially displaced yet horizontally restrained. One manner of accomplishing this is to provide vertically extending slots within channels 8 through which members fixed to bars 6 or 7 project. Members 14 and 16 and respective slots 15 and 24 as illustrated in FIG. 6 are exemplary of this structure.

Turning now to a closer examinination of FIGS. 3, 4 and 5, the anti-tip mechanism of the present invention will be described. Located at one side of the cabinet, locking bar 7 comprises a segmented column consisting of a plurality of longitudinally extending snubber elements 9 axially aligned in end-to-end abutment. The abutting ends of each snubber element 9 are preferably equipped with a roller 13 mounted on an axle 14 which is fixed to its snubber element 9. The entire column or locking bar 7 is resiliently biased by a plurality of springs 18 to assume a central equilibrium position. With this construction the bar and its elements may be displaced to either of two opposite axially displaced positions. If springs 18 are suficiently strong, only the axially uppermost and lowermost snubber elements need be biased in this manner. With less strong springs, however, it might be desirable to resiliently bias each and every snubber element.

Each drawer of the cabinet is outfitted with an activator rail 10 which is carried on the side of the drawer in a position, when the drawer is closed, adjacent to the point of abutment of two adjacent snubber elements 9. The leading end 11 of activator rail 10 is preferably pointed or tapered to have two oppositely inclined camming surfaces 12 so that movement of the drawer in an outwardly direction causes the leading end and eventually the entire activator rail 10 to be insinuated between the adjacent rollers 13 of adjacent snubber elements. It will be understood that this such insertion causes the snubber elements above the drawer to be displaced axially upwardly while the snubber elements below the drawer are simultaneously displaced axially downwardly. FIG. 5 illustrates just such a displaced condition. As can be seen, displacement of the snubber elements in the column causes a roller 13 to be moved to a position which blocks subsequent outward movement of each of the activator elements of each of the remaining unopened drawers. In this manner, the action of opening one drawer effectively precludes subsequent opening of any other drawer of the cabinet.

Furthermore, it can be seen from an examination of the figures that simultaneous opening of more than one drawer is also effectively prevented since simultaneous opening of at least two drawers would require the physical compression or distortion of the snubber element or elements 9 intermediate the activator rails 10 of the two drawers being simultaneously opened. Since snubber elements 9 are constructed of rigid structural material and rollers 13 are fixedly positioned on the ends of their respective snubber elements, compression or distortion of the intermediate snubber elements is an impossibility under loads normally expected to be encountered during normal operation of the filing cabinet.

An additional feature of the invention which prevents simultaneous opening of two or more drawers of the filing cabinet can be found in the manner in which the snubber elements are mounted for axial reciprocation within structural channel 8 of the filing cabinet. Each snubber element 9 lies within the channel 8 while rollers 13 lie on the exterior of the channel. Axle members 14 as best seen in FIG. 6 extend through axially extending slots 15 formed in the side of structural channel 8. Slots 15 are dimensioned to be substantially equal to the sum of the diameter of roller 13, the diameter of the axle 14, and the vertical thickness of an activator rail 10. This being the case, each roller 13 and each snubber element 9 is permitted an axial deflection in either direction which is limited to one-half of the vertical thickness of the activator rails 10 by the axial limits of the slots 15 formed in channel 8 with the effect that each of the snubber elements is locked in its axially displaced position when one of the doors has been opened.

As can be seen best in FIG. 5, the preferred embodiment of activator rail 10 is a "floating rail" and includes a pair of longitudinally extending slots 20 and 21 through which project as pair of mounting shanks or studs 19 and 28. Slot 21 includes a short dog-leg portion 22 at its innermost end adapted to receive shank 28. Depressions 26 are formed at the innermost end of activator rail 10 and cooperate with rollers 13 when the drawer has been pulled out to an extended position. It may further be desirable, as shown at the trailing end of activator rail 27 to taper the rail so as to facilitate insertion of the rail 10 in between adjacent rollers 13 when the drawer is originally inserted into the cabinet.

The just described structure functions in a manner which permits the drawer to be moved to a position external to the cabinet 1 while being supported thereby so that the full filing depth of the drawer 2 can be used when the stored materials are to be drop filed. This feature minimizes the necessary depth of the cabinet. Upon first outward movement of drawer 2, leading end 11 of activator rail 10 insinuates itself between adjacent rollers 13 thereby causing displacement of the snubber elements 9 in the column. As outward movement of the drawer 2 causes stud or shank 19 in slot 20 to move outwardly beyond rollers 13, activator rail 10, under the influence of snubber elements 9, is caused to rotate slightly upwardly so as to withdraw stud 28 from dog-leg 22 of slot 21. This action releases the "floating" activator rail 10 so that the friction between rail 10 and wheels 13 causes the activator rail 10 to lag behind the drawer 2 as it moves to its extended position. Depressions 26 assist further in this action as rollers 13 encounter the depression. As a result, as can be seen from FIG. 5, when drawer 2 is fully extended to its full open position, activator rail 10 is caused to extend out from the back of the drawer in a manner which maintains the anti-tip device in its activated condition.

It will be appreciated that dog-leg 22, provided for receiving support pin 28, prevents the "floating" type action of activator rail 10 upon first movement of the drawer from its fully inserted position. Accordingly, since support pin 28 is received within dog-leg 22, thereby temporarily preventing activator rail 10 from moving relative to the drawer 2, initial outward movement of the drawer causes the leading end 11 of activator rail 10 to force itself between adjacent snubber elements to cause the remaining drawers in the cabinet to be immediately locked in their full in positions.

A further feature of the present invention is the ability of the locking/anti-tip mechanism to simultaneously lock all unopened doors in their closed positions when one of the drawers is moved to its open position. This feature results from the co-action between laterally projecting locking pins 16, carried by snubber element 9, and a C-shaped opening 17 formed in a side flange of each of the doors 3 of the cabinet. When snubber elements 9 are in their central equilibrium positions, the opening of C-shaped slots 17 on each of the drawers is such that each door may be horizontally pivoted around its upper horizontal hinge from a closed to an opened position with pin 16 moving freely through the centrally located exit opening of the slot 17. Deflection of locking pins 16 in either direction resulting from deflection of the snubber elements 9 produced by the opening of one of the drawers 2, causes pins 16 to be moved to an axially displaced position in slot 17 which prevents subsequent outward movement of respective closed door 3. Accordingly, not only are all unopened drawers prevented from subsequent opening by the locking anti-tip mechanism of the present invention, but also each previously unopened door 3 is prevented from subsequent opening.

The above described structure is also useful as a means for permanently locking both drawers and doors in their closed positions when lock cylinder 4 is depressed to assume its locking mode. Such depression causes the locking linkage 5 to actuate camming member 25 in a manner which engages the pin 23 fixed to the upper end of the top snubber element 9. The interaction of camming member 25 and pin 23 causes the vertically downward displacement of all of the snubber elements 9 in the segmented column 7 so that both the door locking pins 16 and the drawer locking rollers 13 are moved to their respective locking positions. Since the construction of many such filing cabinets is such that doors 3 are made out of relatively broad sheets of sheet metal, it is desirable to cause both sides of the door 3 to be locked at the same time as opposed to providing locking of only one side. Accordingly, locking bar 6, which may either be a segmented column having snubber elements as already described, or a solid vertically extending bar, is also provided with locking pins 16 which are received within C-shaped slots 17 formed on the opposite ends of doors 3. In this manner, actuation of lock cylinder 4 and the concomitant operation of linkage 5 causes pin 23 on the upper end of locking bar 6 to be axially deflected downwardly to cause corresponding locking pins 16 to be moved into a position which engages the opposite sides of the doors 3 so that each door is locked from both of its opposite sides.

What is claimed is:

1. An improved cabinet of the type having a case with a plurality of horizontally movable components mounted therein, the improvement characterized by an anti-tip mechanism for preventing more than one component from being opened to its fully extended position at one time, said anti-tip mechanism comprising:

(a) a segmented lock bar extending adjacent each of said components, said lock bar comprising a plurality of longitudinally extending snubber elements axially aligned in end-to-end abutment, said elements being resiliently mounted within said cabinet on said case to permit movement in opposite directions from a central equilibrium position to first and second opposite axially displaced positions; and (b) a plurality of longitudinally extending activator rails each disposed substantially normal to said lock bar, each rail being carried by a different one of said components, each rail being disposed with one of its ends positioned to insinuate itself between adjacent snubber elements when its respective component is opened and so shaped with respect to said adjacent snubber elements to displace all of the snubber elements from their central equilibrium positions to one of said first and second positions with the snubber elements located in one of said directions with respect to said insinuated rail moving to said first axially displaced position and those located in the opposite of said one direction moving to said second axially displaced position, whereby the remainder of said plurality of rails and their respective components are blocked by a displaced snubber element.

2. The improved cabinet as recited in claim 1 characterized in that each rail has a pointed leading end formed of a pair of oppositely facing leading surfaces each inclined to both the longitudinal axis of said lock bar the longitudinal axis of said rail.

3. The improved cabinet as recited in claim 2 characterized in that said snubber elements include rollers at their abutting ends thereby facilitating the insinuation of said pointed end of the respective rail therebetween and subsequent movement of said respective rail between adjacent snubber elements.

4. The improved cabinet as recited in claim 1 characterized by including a spring biasing member associated with each snubber element for resiliently biasing it to its central equilibrium position.

5. The improved cabinet as recited in claim 1 characterized by further including means associated with said case for limiting the degree of axial displacement of each of said snubber elements in a single axial direction to substantially one half of the thickness of one of said rails whereby said snubber elements are permitted to be displaced only so much as to permit a single rail to penetrate through said segmented lock bar.

6. The improved cabinet as recited in claim 5 characterized in that said means for limiting the axial displacement of said lock bar includes a channel mounted on said case within which said snubber elements are mounted, said channel including a plurality of slots and at least one member projecting from each of said plurality of snubber elements through one of said slots, whereby movement of each snubber element is limited by the axial extent of at least one of said slots.

7. The improved cabinet as recited in claim 6 characterized in that said projecting members are the axles of a plurality of rollers each disposed at an end of a respective snubber element, said rollers, said snubber elements, and said rails being disposed so that the end of each rail is adjacent to a pair of adjacent rollers each carried by one end of a different member of a pair of abutting snubber elements whereby outward movement of said component and said rail forces said rail between said pair or rollers while concomitantly causing each of said snubber elements to be axially displaced substantially to the limit of its permitted travel.

8. The improved cabinet as recited in claim 1 characterized in that each activator rail is mounted on the side of a different one of said components by means for permitting said rail to extend in back of its respective component when fully extended, whereby the component is permitted to be extended to its fully extended position without causing said rail to be withdrawn from between the displaced adjacent snubber elements.

9. The improved cabinet as recited in claim 8 characterized in that said rail mounting means includes a pair of horizontally extending slots formed in the side of said rail, and a pair of rail supporting shanks mounted on the side of the component, each shank extending into one of said slots, one slot including a spur portion extending laterally from the main body of said one slot, said spur portion adapted to receive therein its respective shank.

10. The improved cabinet as recited in claim 1 further characterized by including a door for each component, said doors being movable from a closed, component blocking position, to an open, component releasing position, said segmented lock bar including means for engaging and locking each closed door when one component of said cabinet is moved to its extended position.

11. The improved cabinet as recited in claim 10 characterized in that said engaging and locking means includes a plurality of lugs carried by said segmented lock bar and a lug receiving opening formed in a portion of each for, said opening having a profile which permits one of said lugs to be inserted thereinto and withdrawn therefrom when the snubber element carrying the lug is in its central position but which prevents withdrawal of the lug therefrom when the snubber element carrying the lug is in one of its two displaced positions.

12. An improved cabinet of the type having a cabinet housing with a plurality of horizontally movable components mounted therein and an equal plurality of doors movable from a closed, component blocking position to an open, component releasing position, the improvement characterized by including:

(a) lock means for simultaneously locking said doors and said components against movement from their closed to their open positions when in a locking mode and for permitting movement of a single component from its closed to its open position while simultaneously locking both the remaining unopened doors and all of the other components against movement from their closed to their open positions when in an unlocking mode, said lock means includes a vertically disposed locking bar at one side of said cabinet for locking said doors and a segmented column locking bar at the other side of said cabinet, the segments of which are displaced in opposite directions by an opened component to thereby block the other unopened components above and below said opened component from movement towards an opening position.

13. The improved cabinet as recited in claim 12 characterized in that said cabinet is of the lateral file cabinet type having vertically arranged storage units and doors, each of said doors being hung for pivotal movement about a horizontal axis, and characterized in that said lock means includes means for concurrently locking both sides of each door when in its locking mode.

14. The improved lateral file cabinet as recited in claim 13 characterized in that said segmented column comprises a plurality of longitudinally extending snubber elements axially aligned in end-to-end abutting relationship, each of said snubber elements being axially movable from a central rest position to each one of two opposite axially displaced positions, each of said plurality of movable stroage units having mounted thereon a longitudinally extending activator rail, each rail being disposed with an end positioned to insinuate itself between two adjacent snubber elements as its respective storage unit is moved from its closed to its open position while causing each of said two adjacent snubber elements to be displaced in opposite direction from its central rest position to an opposite one of its axially displaced positions, whereby displacement of said two adjacent snubber elements caused all remaining snubber elements to be similarly displaced so that all remaining storage units and their respective activator rails are blocked against subsequent movement from their closed to their open positions.

15. The improved lateral file cabinet as recited in claim 14 characterized in that said lock means includes a plunger lock and a locking linkage functionally connecting said plunger lock and both of said locking bar and said segmented column, said linkage including means for axially displacing and holding each of said locking bar and said segmented column when said lock means is in its locking mode.

16. The improved lateral file cabinet as recited in claim 15 characterized in that both said locking bar and said segmented column include means for engaging and locking each of said doors.

* * * * *

UNITED STATES PATENT AND TRADEMARK OFFICE

CERTIFICATE OF CORRECTION

PATENT NO. : 4,272,138

DATED : June 9, 1981

INVENTOR(S) : Forest G. Stark

It is certified that error appears in the above—identified patent and that said Letters Patent is hereby corrected as shown below:

Column 8, line 1, "for" should read --- door ---.

Signed and Sealed this

*Fifteenth* Day of *December 1981*

[SEAL]

*Attest:*

GERALD J. MOSSINGHOFF

*Attesting Officer*

*Commissioner of Patents and Trademarks*